US005480157A

United States Patent [19]

Plummer

[11] Patent Number: 5,480,157

[45] Date of Patent: Jan. 2, 1996

[54] FACT GAME AND METHOD OF PLAYING THE SAME

[76] Inventor: Donna M. Plummer, #151 Rte. 125, Barrington, N.H. 03825

[21] Appl. No.: 337,069

[22] Filed: Nov. 10, 1994

[51] Int. Cl.[6] ..... A63F 9/18

[52] U.S. Cl. ..... 273/432

[58] Field of Search ..... 273/429–432, 273/240

[56] References Cited

U.S. PATENT DOCUMENTS

| | | | |
|---|---|---|---|
| 3,603,592 | 9/1971 | Bury | 273/240 |
| 4,059,275 | 11/1977 | Price | 273/240 X |
| 4,109,918 | 8/1978 | Mele et al. | 273/240 X |
| 4,884,816 | 12/1989 | Ford et al. | 273/240 |
| 5,297,801 | 3/1994 | Croker | 273/430 |

OTHER PUBLICATIONS

Playthings, Sep. 1987, p. 23, Blarney.

*Primary Examiner*—Paul E. Shapiro
*Attorney, Agent, or Firm*—Davis, Bujold & Streck

[57] ABSTRACT

A novel game which asks the contestants facts concerning their lives. The contestants, excluding the present dealer, record their respective answer, to each posed question, on an answer tablet using a writing instrument. Once each contestant, excluding the present dealer, has responded to the posed question, the tablets are placed face down in a reading area. Thereafter, the reader shuffles and then reads each answer aloud to one of the contestants (the dealer) who attempts to match each read answer with the contestant providing that answer. In the event that the dealer correctly matches the answer with the contestant, the betting chips wagered on that question by that contestant are awarded to the contestant (the dealer) who made the correct match. In the event that the contestant (the dealer) is unable to correctly match the answer to the appropriate contestant, then the contestant (the dealer) who made the incorrect match has to award an equal amount of wagered chips to each person that such contestant (the dealer) was unable to provide a correct answer.

3 Claims, 2 Drawing Sheets

FACT GAME AND METHOD OF PLAYING THE SAME

FIELD OF THE INVENTION

This invention relates to a game concerning true facts about the lives of the contestants who are playing the game and method of playing the same.

BACKGROUND OF THE INVENTION

In recent years, there have been a number of adult games which utilize questions and answers. Some examples of these games include responding to trivia questions, and providing a drawing of an object posed on a playing card whereby a team member is to guess what is being drawn. None of the prior art games request a response from the contestant which invoke a response about the contestant's personal life, feelings, political beliefs, etc. In addition, none of the prior art games involve making a chip wager wherein the winner is determined by whether or not a response is correctly matched to the person who provided that response.

OBJECTS OF THE INVENTION

Accordingly, it is an objective of the present invention to provide a game concerning true facts about the lives of the contestants who are playing the game.

Another objective is to provide a game wherein a dealer poses a question to each contestant, each contestant responds to the question by writing down his/her answer, revealing each responded answer to the dealer where the dealer attempts to match each responded answer to the contestant that provided the answer.

Another objective of the invention is to provide a game in which chips are wagered and, if the dealer correctly matches the response to the contestant making this response, the dealer is awarded the chips wagered by the contestant otherwise the dealer must awarded that contestant amount of chips equal to the amount wagered.

SUMMARY OF THE INVENTION

According to the present invention there is provided a game relating to a series of questions posed to contestants during the course of playing the game, said game comprising a plurality of betting chips to be equally distributed to each contestant and wagered by each contestant during the course of playing the game; a mechanism for determining which contestant will match answers to the other contestant; a deck of cards containing a plurality of different cards with each card of said deck of cards asking a question requesting a factual response concerning the lives of the contestants playing the game; a plurality of answer tablets for facilitating the contestants responding to each factual inquiry concerning a card selected from said deck of cards.

Also according to the invention there is provided a method of playing a game comprising a plurality of betting chips to be equally distributed to each contestant and wagered by each contestant during the course of playing the game; a mechanism for determining which contestant will match answers to the other contestant; a deck of cards containing a plurality of different cards with each card of said deck of cards asking a question requesting a factual response concerning the lives of the contestants playing the game; a plurality of answer tablets for facilitating the contestants responding to each factual inquiry concerning a card selected from said deck of cards, said method comprising the steps of: a) providing each contestant and a dealer with a writing instrument and an answer tablet and a equal number of betting chips; b) determining the playing order of the contestants playing the game; c) said dealer selecting a card from a deck of cards and reading a question posed in said selected card aloud to each said contestant; d) each said contestant placing a wager, by selecting a desired number of said betting chips to wager, on said read question; e) each said contestant secretively responding to said read question by indicating an answer on the answer tablet using the writing instrument; f) once each said contestant has responded to said read question, placing the answer tablet face down; g) shuffling said answer tablets; h) having one contestant read each said answer; i) having said dealer match each said read answer to the contestant believed to have provided such answer; j) awarding said dealer said wagered betting chips for each said answer correctly matched to the contestant believed to have provided such answer; and k) said dealer awarding said wagered betting chips for each said answer incorrectly matched to the contestant believed to have provided such answer.

BRIEF DESCRIPTION OF THE DRAWINGS

The invention will now be described, by way of example, with reference to the accompanying drawings in which.

DESCRIPTION OF THE PREFERRED EMBODIMENTS

Figure 1:
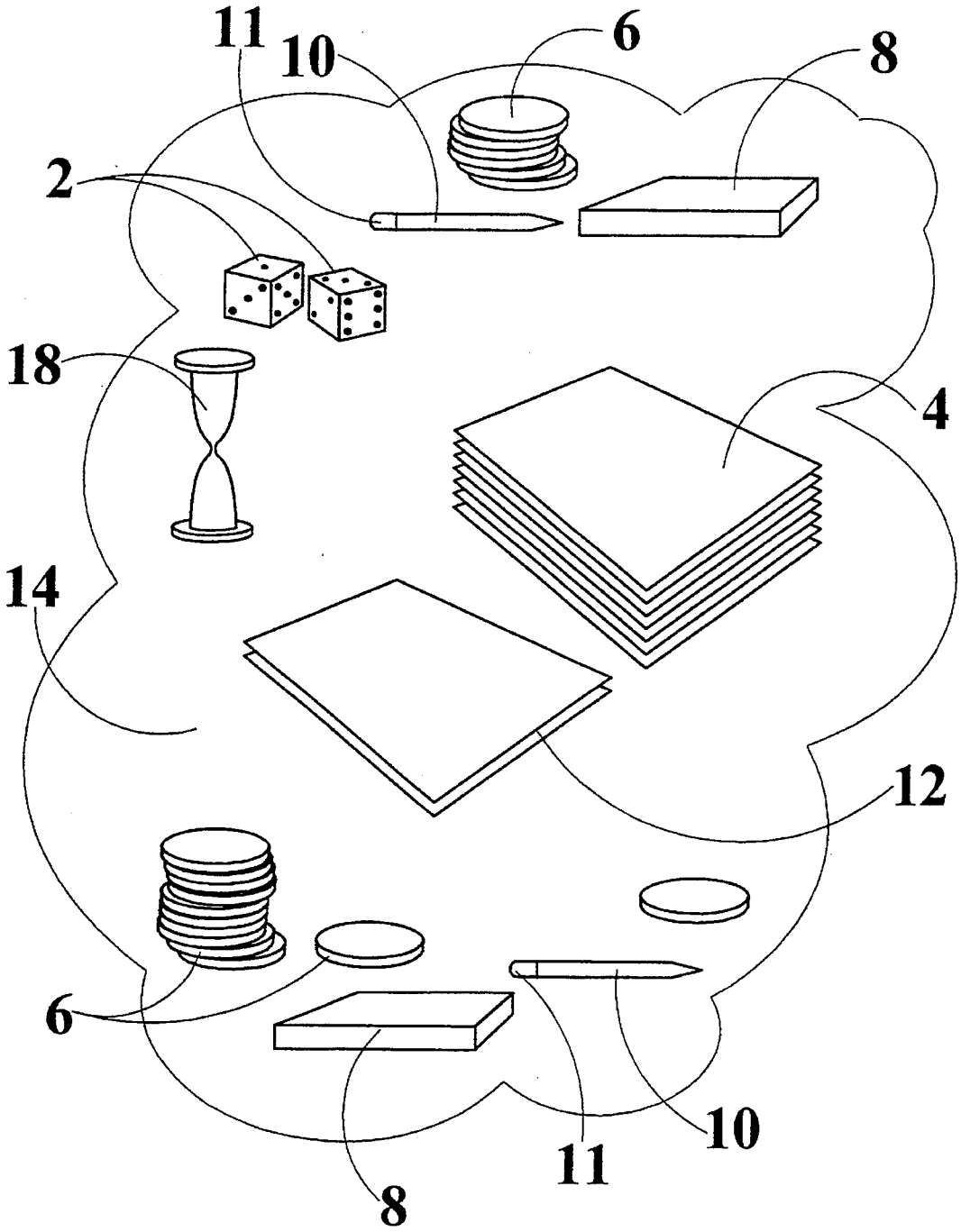
FIG. 1 is a diagrammatic perspective view showing the components for playing the game according to the present invention; and, FIG. 2 is a diagrammatic view of a game board for playing the game according to the present invention.

Turning now to FIG. 1, a detailed description of the present invention will now be provided. The game 1, according to the present invention, comprises at least one die 2 (two dice are shown in FIG. 1) and a deck of "True Fact" playing cards 4. Each card 12 forming the deck of cards is unique, except for 15 "dealer choice" playing cards, and requests a different fact about the contestants for playing the game. Each "dealer choice" playing card allows the dealer to select his/her own true fact question to ask the contestants. Typically, there are at least 185 different playing cards plus the 15 "dealer choice" playing cards which comprise the deck of cards 4. It is to be appreciated that a different number of playing cards may be utilized and the cards may pose questions which may be grouped in a number of different categories, e.g. six categories. There are also a plurality of betting chips 6 which facilitates scoring while playing the game, e.g. two hundred betting chips.

The game 1 also includes an erasable board or answer tablet 8 which the contestants use to memorialize their answer to the questions posed while playing the game. The tablet may be a pad of paper having several perforations on each sheet thereby allowing the contestants to write their answer on one section at a time, tear off that section, and place it in a tablet container 22 (reader's box, see FIG. 2). The contestant can use the same answer sheet several times thereby conserving paper. A writing utensil 10, such as a pen, pencil or chalk is used in combination with the answer tablet 8 to generate a response and an eraser 11 for clearing the answer tablet 8 can also be provided if necessary.

Finally, the game may optionally include a timer 18, e.g a one–three minute timer, to time the answering of each posed question and the matching of the responses with the contestants, and such procedures will be described in further detail hereinafter.

Figure 2:
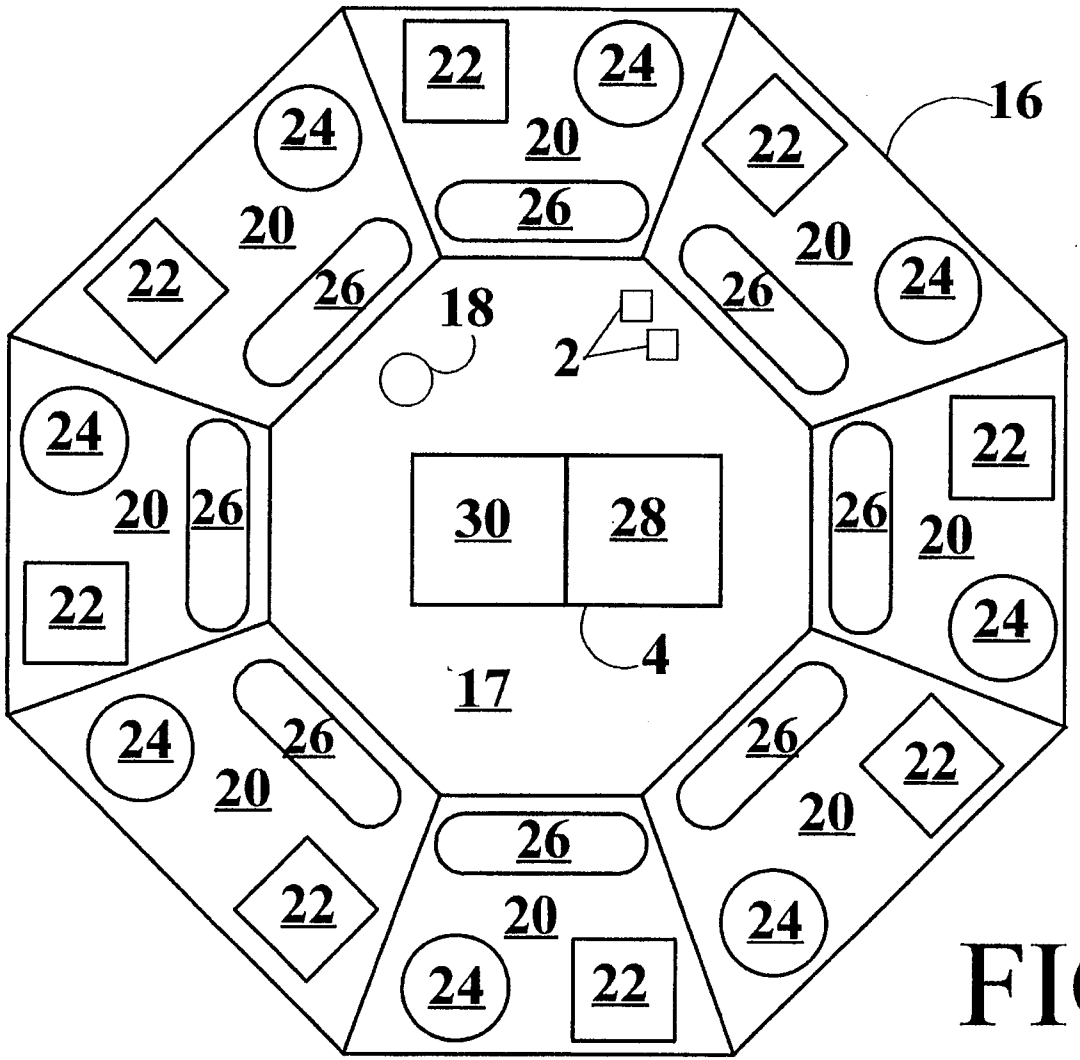

Turning now to FIG. 2, there is shown an optional game board 16 used to assist with playing the game. The board 16 shown includes eight playing positions 20, but may include up to ten playing positions. Each playing position may have a tablet container 22 (reader's box) where the selected answer is placed, a well 24 for storing betting chips 6 (not shown), and a betting box 26 where betting chips 6 are placed for entering a wager. At the center of the board 16, the deck of cards 4 may be placed. The deck of cards has a face down portion 28 and a face up portion 30 used to place each card 12 when each card 12 is turned up after being read to the contestants for their review when responding to the posed question. The inner portion 17 of board 16 may be used to place the optional timer 18 and die or dice 2. Each playing position 20 may also contain the writing utensil 10 with eraser 11 and answer tablet 8 (not shown).

Playing the Game

Each contestant is first given an answer tablet 8, a writing utensil 10 and an eraser 11. Next, the plurality of betting chips 6 are divided equally among all of the contestants participating in the game, e.g. at least ten betting chips 6 are given to each contestant. Thereafter, the deck of cards 4 is thoroughly shuffled and placed in the center of the playing area 14 or anywhere in the inner portion 17 of the game board 16, in the event a game board is used. All of the contestants then roll the die or dice 2 and the contestant with the highest number displayed by the die or dice 2 will be the "dealer" first. If there is a tie by two or more contestants, those contestants will again roll the die or dice 2 until one of the contestants rolls the highest number and the "dealer" is thus determined.

The dealer then selects a card from the deck of cards 4, e.g. the top card of the deck, and reads the selected card 12 to the other contestants playing the game to inform them which fact about their lives is to be recorded on the answer tablets 8. The dealer then turns the selected card 12 face up on the playing area 14 or, of a game board 16 is used, in the inner portion 17, so that the contestants may further consider the posed question and, if the timer 18 is utilized, commences timing of the answers. Each contestant then places a wager by selecting a desired number of betting chips 6 to wager on the posed question, e.g one or two betting chips 6, and secretively responds to the question by writing his or her answer on the answer tablet 8 using the writing instrument 10. Once each contestant appropriately responds to the posed question, except for the dealer, the contestants place their answer tablets face down on a designated area of the game board 16 or in a tablet container 22 (reader's box) so that the answers are not visible. After all of the contestants have responded to the question and placed their answer tablets 8 in the designated area or in the tablet container 22 (reader's box), the answer tablets 8 are then mixed and/or shuffled by one of the contestants, e.g. the contestant to the right of the dealer. Once the answer tablets are completely shuffled, the answer to the posed question recorded on each answer tablet 8 is read aloud by the contestant to the right of the dealer and, if the timer 18 is utilized, timing of the matching procedure commences upon initiating reading of the first answer aloud. The answer is read to the dealer so that the dealer is prevented from recognizing a particular contestant's handwriting. Once each answer is read aloud, the dealer must match the read answer with the contestant whom the dealer believes provided that answer to the currently posed question. Once the dealer has matched read answer with a selected contestant, the contestant reading the answers then places the read answer tablet 8 face down in front of the person or on the playing board in that person's designated area to whom the dealer indicated as providing that response. Once all of the answer tablets 8 have been read aloud and matched by the dealer with the contestant whom the dealer believes provided that answer to the currently posed question, each contestant successively then reveals to the dealer whether or not the answer placed in front of that contestant coincides with the answer provided by that contestant with respect to the current posed question.

In the event that the answer on the answer tablet 8 coincides with the answer provide by that contestant, then all of the betting chip(s) 6 wagered by that contestant on the currently posed question is/are awarded to the dealer. In the event that the dealer incorrectly matches the answer on the answer tablet 8 with the contestant, then the dealer awards that contestant whom the dealer was unable to correctly match his/her answer with an equal amount of wagered betting chips 6 concerning the currently posed question.

Play then continues with another contestant, e.g. the person sitting to the right of the dealer, becoming the dealer. The new dealer then selects a card 12 from the deck of cards 4 and promptly reads that question to the other contestants, including the previous dealer. The dealer then turns the selected card 12 face up on the playing area 14 or, if a game board 16 is used, in the inner portion 17, so that the contestants may further consider the posed question and, if the timer 18 is utilized, commences timing of the answers. Each contestant then places a wager by selecting a desired number of betting chips 6 to wager on the posed question, e.g one or two betting chips 6, and secretively responds to the question by writing his or her answer on the answer tablet 8 using the writing instrument 10. Once each contestant appropriately responds to the posed question, except for the dealer, the contestants place their answer tablets 8 face down on a designated area of the game board 16 or in a tablet container so that the answers are not visible. After all of the contestants have responded to the question and placed their answer tablets in the designated area or in the tablet container 22 (reader's box), the answer tablets 8 are then mixed and/or shuffled by one of the contestants, e.g. the contestant to the right of the dealer. Once the answer tablets are completely shuffled, the answer to the posed question recorded on each answer tablet 8 is read aloud by the contestant to the right of the dealer and, if the timer 18 is utilized, timing of the matching procedure commences upon initiating reading of the first answer aloud. Once each answer is read aloud, the dealer must match the read answer with the contestant whom the dealer believes provided that answer to the currently posed question. Once the dealer has matched the read answer with a selected contestant, the contestant reading the answers then places the read answer tablet 8 face down in front of the person to whom the dealer indicated as providing that response. Once all of the answer tablets 8 have been read aloud and matched by the dealer with the contestant whom the dealer believes provided that answer to the currently posed question, each contestant successively then reveals to the dealer whether or not the answer placed in front of that contestant coincides with the answer provided by that contestant with respect to the current posed question.

In the event that the answer on the answer tablet 8 coincides with the answer provide by that contestant, then all of the betting chip(s) 6 wagered by that contestant on the currently posed question is/are awarded to the dealer. In the event that the dealer incorrectly matches the answer on the answer tablet 8 with the contestant, then the dealer awards that contestant whom the dealer was unable to correctly match his/her answer with an equal amount of wagered betting chips 6 concerning the currently posed question.

Play continues with each contestant sequentially taking a turn being the dealer so that each time a new question is read aloud by a different contestant to the other contestants. When one or more of the contestants no longer has any betting chips 6, each contestant counts their acquired betting chips 6 and the contestant with the most betting chips 6 is deemed to be the winner.

Sample questions for the deck of cards would be: "You and Shopping", "You and Tests", "You and Food", "You and Golfing", "You and Recreation", "Your Love Life", "Your Underwear", "You and School", "You and Alcohol", "You and Dancing", "You and Eating", "You and Your Boss", "Your Eyes", "You and Sports", "Your Hair", "Your Weight", "You and the Dark", "You and Beaches", "Your Chest", "Your Height", "Your Sex Life", "Your Body", "Your Friend", "You and Pain", "Your Fears", "You and Drinking", "You and Kissing", "Your First Love", "You and Cars", "You and Jewelry", "Your Hands", "Your Fantasy", "Your Sleep Wear", "Your Home", "Your Embarrassment", "Your Neighbors", "Your Nose", "You and Music", "Your Hang-Ups", "You and Reading", "Your Ears", "Your Dreams", "Your Cooking", "You and Your Job", "How You Dress", "Your Last Vacation", "Your Pet", "You and The Law", "Your Lover/Spouse", "Your Drivers Test", "Your and The Police", "Your and Tipping", "Your Teeth", "Your Credit History", "Your Habits", "Your and Sweets", "Your Work Ethics", "Your Feet", "Your Report Card", "You and Swimming", "Your In-Laws", "Your Handwriting", "You and Valentine's Day", "You and New Years", "Your Sleeping Habits", "You and Mornings", "You and Spicy Foots", "You and Christmas", "Your Bedroom", "You and Shopping", "You and A Celebration", "Your Driving, Skills", "Your Singing Ability", "You and Commitment", "You and The Telephone", "You and Punctuality", "You and Easter", "You and Chores", "Your Personality", "How You Spend Time-Off", "You and Scary Movies", "Your Voice", and "You and Late Nights", for example.

Since certain changes may be made in the above game and method without departing from the spirit and scope of the invention herein involved, it is intended that all matter contained in the above description or shown in the accompanying drawings shall be interpreted merely as examples illustrating the inventive concept herein and shall not be construed as limiting the invention.

Wherefore, I claim:

1. A method of playing a game comprising a plurality of betting chips to be equally distributed to each contestant and wagered by each contestant during the course of playing the game; a mechanism for determining which contestant will match answers to the other contestant; a deck of cards containing a plurality of different cards with each card of said deck of cards asking a question requesting a factual response concerning the lives of the contestants playing the game; a plurality of answer tablets for facilitating the contestants responding to each factual inquiry concerning a card selected from said deck of cards, said method comprising the steps of:

a) providing each contestant and a dealer with a writing instrument and an answer tablet and a equal number of betting chips;

b) determining the playing order of the contestants playing the game;

c) said dealer selecting a card from a deck of cards and reading a question posed in said selected card aloud to each said contestant;

d) each said contestant placing a wager, by selecting a desired number of said betting chips to wager, on said read question;

e) each said contestant secretively responding to said read question by indicating an answer on the answer tablet using the writing instrument;

f) once each said contestant has responded to said read question, placing the answer tablet face down;

g) shuffling said answer tablets;

h) having one contestant read each said answer;

i) having said dealer match each said read answer to the contestant believed to have provided such answer;

j) awarding said dealer said wagered betting chips for each said answer correctly matched to the contestant believed to have provided such answer; and k) said dealer awarding said wagered betting chips for each said answer incorrectly matched to the contestant believed to have provided such answer.

2. A method according to claim 1, further comprising the steps of:

a) selecting a new dealer;

b) repeating steps c) through k); and, c) determining a winner by determining which contestant has been awarded the most betting chips.

3. A method according to claim 1, further comprising the steps of:

a) setting a time limit for responding to said read question.

* * * * *